US010143285B2

(12) United States Patent
Stephens et al.

(10) Patent No.: US 10,143,285 B2
(45) Date of Patent: Dec. 4, 2018

(54) NOZZLE

(71) Applicant: Dyson Technology Limited, Wiltshire (GB)

(72) Inventors: Philip Jonathan Stephens, Swindon (GB); Boris Zukina, Bristol (GB); Christopher John Tyler, Leicester (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 335 days.

(21) Appl. No.: 15/205,594

(22) Filed: Jul. 8, 2016

(65) Prior Publication Data

US 2017/0006991 A1 Jan. 12, 2017

(30) Foreign Application Priority Data

Jul. 10, 2015 (GB) ..... 1512090.0

(51) Int. Cl.
*A45D 20/12* (2006.01)

(52) U.S. Cl.
CPC ..... *A45D 20/122* (2013.01)

(58) Field of Classification Search
CPC ..... A45D 20/00; A45D 20/12; A45D 20/122; B01D 46/00; B01D 46/024
USPC ..... 34/95–100
See application file for complete search history.

(56) References Cited

U.S. PATENT DOCUMENTS 3,943,329 A * 3/1976 Hlavac ..... A45D 20/122 219/486
5,572,800 A * 11/1996 West ..... A45D 20/12 34/390
5,649,370 A * 7/1997 Russo ..... A45D 20/12 34/97
5,987,771 A * 11/1999 Curtin ..... A45D 34/00 34/97
7,644,511 B2 * 1/2010 Ishikawa ..... A45D 20/12 132/220

(Continued)

FOREIGN PATENT DOCUMENTS

CN 202874233 4/2013
CN 203341189 12/2013

(Continued)

OTHER PUBLICATIONS

Search Report dated Jan. 7, 2016, directed to GB Application No. 1512090.0; 1 page.

(Continued)

*Primary Examiner* — Stephen M Gravini
(74) *Attorney, Agent, or Firm* — Morrison & Foerster LLP

(57) ABSTRACT

A nozzle for attachment to a hair dryer includes a body and an airflow guiding member. The body has an internal surface which defines an airflow duct which extends from an air inlet end for receiving an airflow to a slot-shaped air outlet end of the body. The internal surface has opposing first surface sections which taper inwardly towards the air outlet end, and opposing second surface sections which taper outwardly towards the air outlet end. The airflow guiding member guides a first portion of a received airflow towards one of the second surface sections, and a second portion of the received airflow towards the other of the second surface sections.

14 Claims, 7 Drawing Sheets

(56) References Cited

U.S. PATENT DOCUMENTS

| | | | | |
|---|---|---|---|---|
| 8,240,317 | B2 * | 8/2012 | Aguti | A45D 20/12 132/271 |
| 8,959,788 | B2 * | 2/2015 | Hada | A45D 20/10 34/283 |
| 9,554,634 | B2 * | 1/2017 | Yoe | A45D 20/12 |
| 9,622,561 | B2 * | 4/2017 | Cohen | A45D 20/12 |
| 9,635,922 | B2 * | 5/2017 | Logsdon | A45D 20/12 |
| 9,675,158 | B2 * | 6/2017 | Soresina | A45D 20/12 |
| 9,693,616 | B2 * | 7/2017 | Sakuma | A45D 20/12 |
| 9,743,737 | B1 * | 8/2017 | Malbrough | A45D 20/122 |
| 9,808,067 | B2 * | 11/2017 | Sutter | A45D 20/10 |
| D804,724 | S * | 12/2017 | Ceva | D28/19 |
| 9,936,788 | B2 * | 4/2018 | Stephens | A45D 20/122 |
| 9,936,789 | B2 * | 4/2018 | Stephens | A45D 20/122 |
| 9,961,979 | B2 * | 5/2018 | Rodrigues | A45D 20/12 |
| 2003/0159306 | A1 * | 8/2003 | Yeung | A45D 20/12 34/96 |
| 2004/0172847 | A1 | 9/2004 | Saida et al. | |
| 2008/0263887 | A1 | 10/2008 | Nakasone et al. | |
| 2009/0188257 | A1 * | 7/2009 | Kirby | F01D 17/105 60/785 |
| 2013/0239427 | A1 | 9/2013 | Quessard et al. | |
| 2014/0261578 | A1 * | 9/2014 | Belanger | B60S 3/04 134/123 |
| 2015/0335128 | A1 | 11/2015 | Larkin et al. | |
| 2017/0006991 | A1 * | 1/2017 | Stephens | A45D 20/122 |
| 2018/0042356 | A1 * | 2/2018 | Pavis | A45D 20/12 |

FOREIGN PATENT DOCUMENTS

| | | | | |
|---|---|---|---|---|
| CN | 204157879 | | 2/2015 | |
| EP | 1 985 197 | | 10/2008 | |
| EP | 2 567 632 | | 3/2013 | |
| GB | 2516478 | | 1/2015 | |
| GB | 2540203 | A * | 1/2017 | A45D 20/122 |
| JP | 63-48503 | | 4/1988 | |
| JP | 3014299 | | 5/1995 | |
| JP | 2004-357763 | | 12/2004 | |
| JP | 2005-547 | | 1/2005 | |
| JP | 2008-104499 | | 5/2008 | |
| JP | 2008-200429 | | 9/2008 | |
| JP | 2010-274050 | | 12/2010 | |
| JP | 2013-162830 | | 8/2013 | |
| JP | 2017018593 | A * | 1/2017 | A45D 20/122 |
| KR | 20-2011-0002484 | | 3/2011 | |
| KR | 10-1372045 | | 3/2014 | |
| WO | WO-2009/081426 | | 7/2009 | |
| WO | WO-2015/001306 | | 1/2015 | |

OTHER PUBLICATIONS

International Search Report and Written Opinion dated Jul. 27, 2016, directed to International Application No. PCT/GB2016/051498; 10 pages.

* cited by examiner

NOZZLE

REFERENCE TO RELATED APPLICATIONS

This application claims the priority of United Kingdom Application No. 1512090.0, filed Jul. 10, 2015, the entire contents of which are incorporated herein by reference.

FIELD OF THE INVENTION

The present invention relates to a nozzle for a hair dryer.

BACKGROUND OF THE INVENTION

It is known to provide a hair dryer with one or more nozzles for selective attachment to the airflow outlet end of the hair dryer to modify the profile of the airflow emitted from the hair dryer. One form of nozzle is a concentrator, which serves to concentrate the airflow towards a selected portion of the user's hair for localized styling or drying. In general, a concentrator has a main body with a circular air inlet for receiving the airflow from the hair dryer, and a slot-shaped air outlet for emitting the airflow. Another form of nozzle is a diffuser, which serves to reduce the velocity of the airflow emitted from the hair dryer before it is incident upon the hair of the user. A diffuser generally comprises a baffle and a grille connected to the baffle. The baffle comprises an air inlet and an outwardly tapering wall which extends from the air inlet to the grille. The grille provides air outlets from which air is emitted from the diffuser. A set of projections or prongs are generally upstanding from the grille to contact the hair of the user during drying.

SUMMARY OF THE INVENTION

The present invention provides a nozzle for attachment to an airflow outlet end of a hair dryer, the nozzle comprising a body comprising an internal surface which defines an airflow duct which extends from an air inlet end to a slot-shaped air outlet end, the internal surface comprising a pair of opposing first surface sections which taper inwardly towards the air outlet end, and a pair of opposing second surface sections which taper outwardly towards the air outlet end; and, located at least partially within the airflow duct, an airflow guiding member for guiding a first portion of a received airflow towards one of the second surface sections, and a second portion of the received airflow towards the other of the second surface sections.

The nozzle combines aspects of existing concentrator and diffuser nozzles. The internal surfaces of the body are shaped to form a slot-shaped opening at the air outlet end of the body to allow a user to direct the airflow emitted from the nozzle towards a selected portion of hair, for example a portion of hair wrapped around a brush for styling. The provision of the airflow guiding member located at least partially within the airflow duct encourages a received airflow to divide into two respective portions, each of which is guided towards a respective one of the second surface sections which taper outwardly towards the air outlet end of the body. Part of each portion of the airflow can become attached to its respect second surface section, which can thus serve to guide part of the airflow towards the side extremities of the slot-shaped air outlet end of the body. This can result in the emission from the nozzle of an airflow having a consistently narrow (insofar as the width of the airflow is greater than the height of the airflow), outwardly flared profile. We have found that, for a given airflow received at the air inlet end of the body, the shaping of the airflow by the nozzle into a narrow, but outwardly flared, airflow profile can improve user comfort during hair styling in comparison to when a similarly narrow airflow is emitted from the nozzle without such an outwardly flared profile. The outward flaring reduces the velocity at which the airflow is emitted from the nozzle, improving user comfort and hair styling performance. The converging first surface sections of the internal surface ensure that some of the airflow is guided towards the central portion of the air outlet end so that the airflow is emitted evenly along the air outlet end of the body.

The air inlet end of the body is preferably generally circular in shape. The air inlet end may comprise a single circular air inlet concentric with the longitudinal axis of the nozzle. In a preferred embodiment, the airflow guiding member is located at least partially within the air inlet end of the airflow duct and defines with the body at least one air inlet of the nozzle. In a preferred embodiment, the air inlet(s) is spaced from the longitudinal axis of the nozzle. The air inlet(s) may comprise at least one slot. In the preferred embodiment the nozzle comprises a single air inlet in the form of an annular slot. Such a nozzle is suitable for use with the type of hair dryer described in WO2015/001306, the contents of which are incorporated herein by reference, in which a hot air flow is emitted from an annular slot located at the air outlet end of the hair dryer. As an alternative to providing an air inlet in the form of an annular slot, the nozzle may comprise a plurality of curved, slot-shaped air inlets, a plurality of circular air inlets, arranged in a circular pattern in the air inlet end of the nozzle, or a single circular opening.

The airflow guiding member preferably comprises an airflow guiding vane, hereafter referred to as a first airflow guiding vane. The first airflow guiding vane is preferably located within a first plane. At the air outlet end, that first plane preferably intersects the first surface sections at a right angle. In a cross-section taken along a second plane orthogonal to the first plane, each of the second surface sections is preferably inclined relative to the first plane by an angle in the range from 5 to 15°. This range of angles is selected to optimize the spread of the airflow emitted from the nozzle, and thus the mean and peak velocities of the airflow emitted from the nozzle. In a cross-section taken along the first plane, each of the first surface sections is preferably inclined relative to the second plane by an angle between 0 and 20°. These angles are also selected to optimize the acoustic performance of the nozzle, as any sudden changes in the airflow direction within the nozzle, which may generated turbulence in the airflow, are avoided.

The airflow guiding member may be shaped such that at least part of the outer surface of the airflow guiding member tapers inwardly towards the air outlet end. For example, at least part of the outer surface of the airflow guiding member may have the general shape of a duck's bill. In other words, the airflow guiding member may have a generally conical outer surface with a planar first airflow guiding vane protruding forwardly from the distal end of that surface.

The airflow guiding member may be integral with the body. In a preferred embodiment, the airflow guiding member is connected to the body, for example using an adhesive or using a welding technique, such as ultrasonic welding. During assembly, the airflow guiding member may be inserted at least partially into the body through the air inlet end, and connected to the body. The airflow guiding member may be connected to a support member, which is in turn connected to, or integral with, the body. Alternatively, the airflow guiding member may be connected to an airflow guiding vane, hereafter referred to as a second air guiding vane, located within the airflow duct. For example, the body may comprise a second airflow guiding vane for promoting the generation of a laminar airflow within the airflow duct. Such a vane may extend across at least part of the airflow duct. The second airflow guiding vane is preferably a planar vane which is located within the second plane so that the second airflow guiding vane is substantially orthogonal to the first airflow guiding vane. The second airflow guiding vane may be spaced from the first airflow guiding vane, but in a preferred embodiment the first airflow guiding vane comprises a slot for receiving part, preferably a central part, of the second airflow guiding vane. The slot is preferably located at the tip of the first airflow guiding vane.

During use, a hot airflow passes through the airflow duct, which will cause the temperature of the external surface of the body to rise. To shield the user from contact with that external surface, the nozzle preferably comprises a sleeve which extends about the body. The sleeve preferably defines an airflow channel through which ambient air is drawn by the emission of air from the air outlet end of the body. That airflow channel is preferably located between the internal surface of the sleeve and the external surface of the body so that the ambient airflow passes over the external surface of the body to allow heat to be transferred from the body to the ambient airflow.

BRIEF DESCRIPTION OF THE DRAWINGS

Preferred features of the present invention will now be described by way of example only with reference to the accompanying drawings, in which.

DETAILED DESCRIPTION OF THE INVENTION

FIGS. 1 to 5 are external views of a nozzle 10. The nozzle 10 comprises an air inlet 12 for receiving an airflow from an airflow outlet end of a hair dryer, and an air outlet 14 for emitting the airflow. The air inlet 12 is generally annular in shape, and is in the form of an annular slot located at one end of the nozzle 10. The air outlet 14 is in the form of an elongate slot located at the other end of the nozzle 10.

Figure 1:
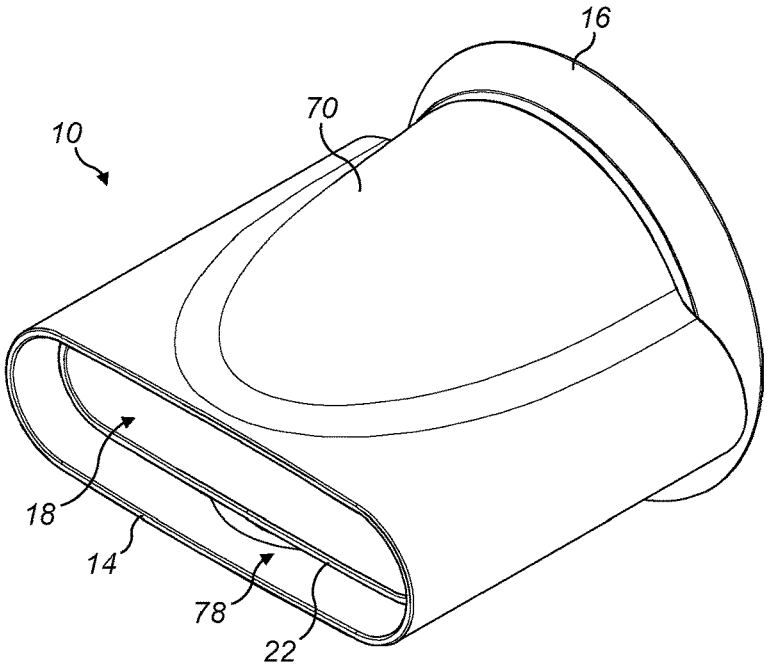
FIG. 1 is a left side, front perspective view, from above, of a nozzle.
Figure 2:
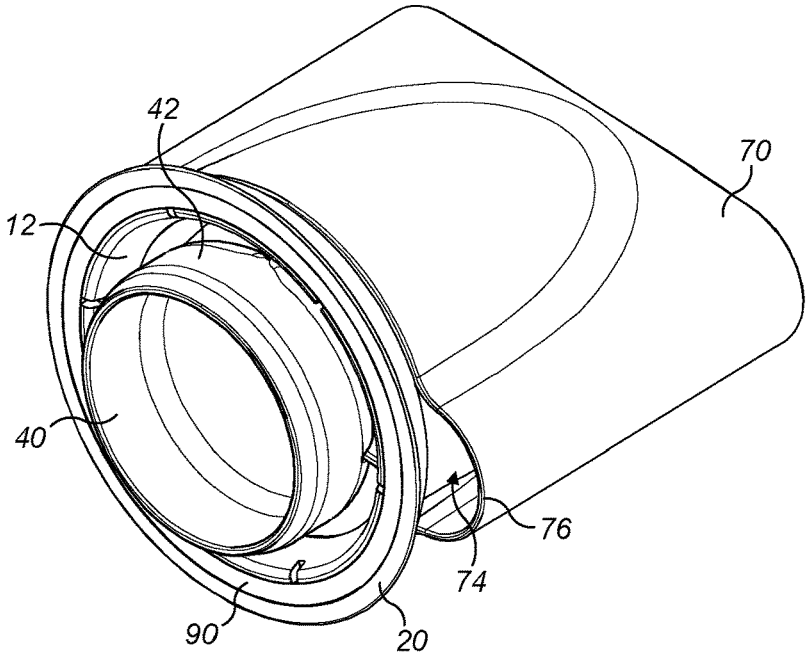
FIG. 2 is a right side, rear perspective, from above, of the nozzle.
Figure 3:
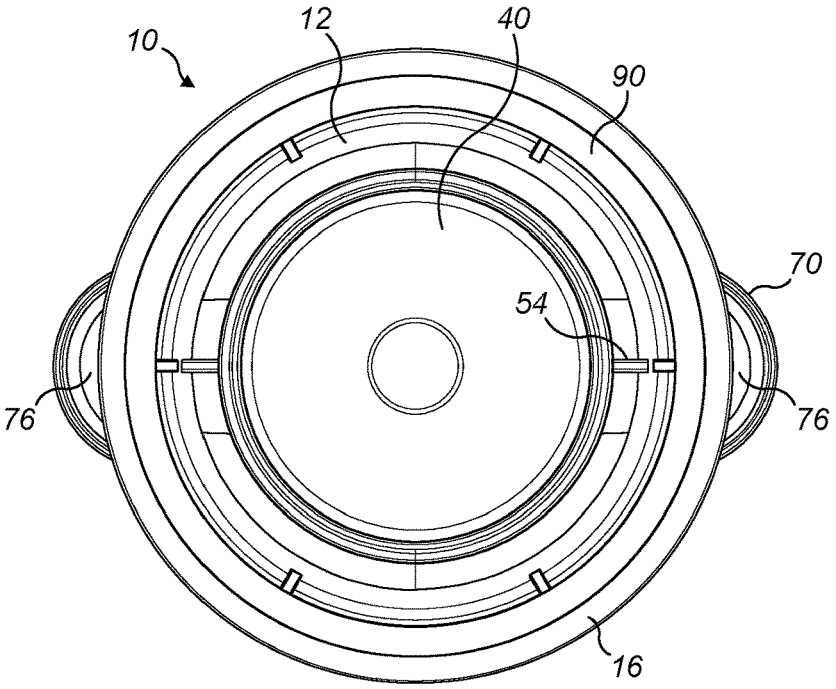
FIG. 3 is a rear view of the nozzle.
Figure 4:
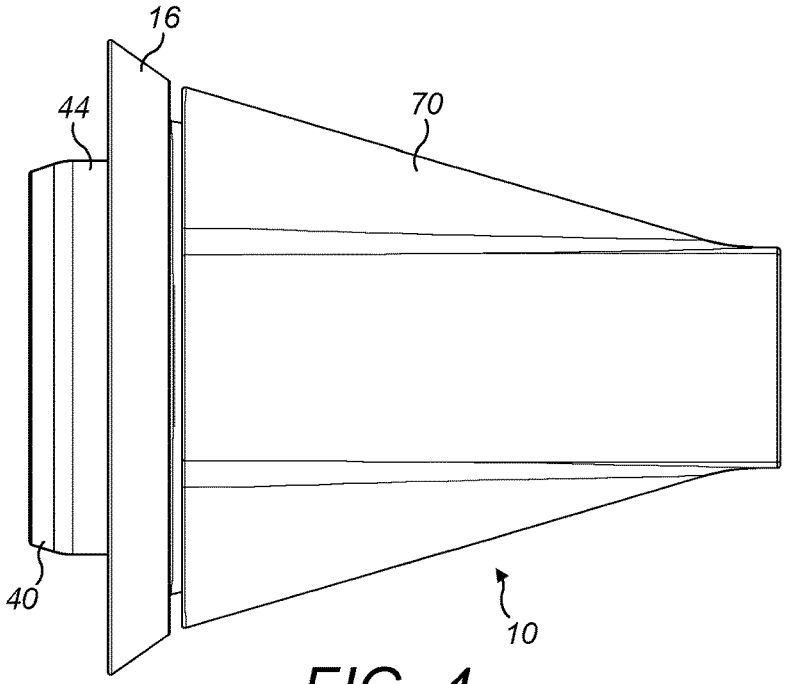
FIG. 4 is a side view of the nozzle.
Figure 5:
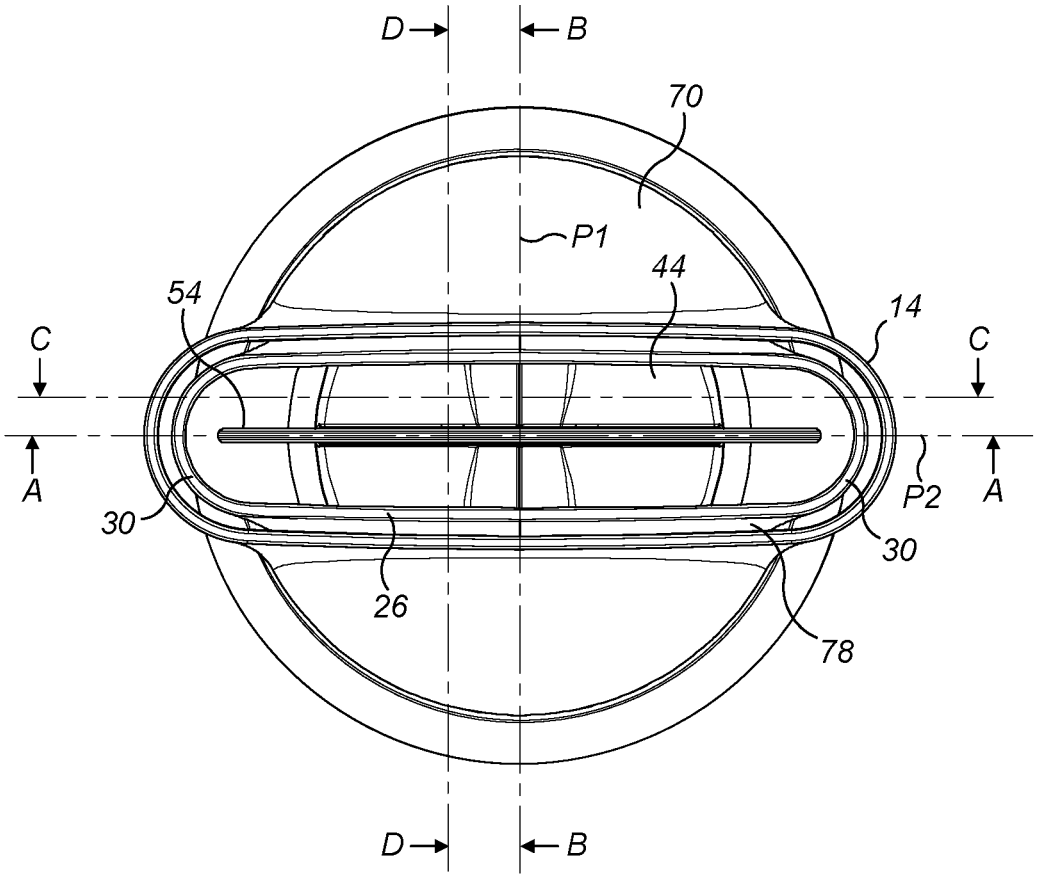
FIG. 5 is a front view of the nozzle.
Figure 6:
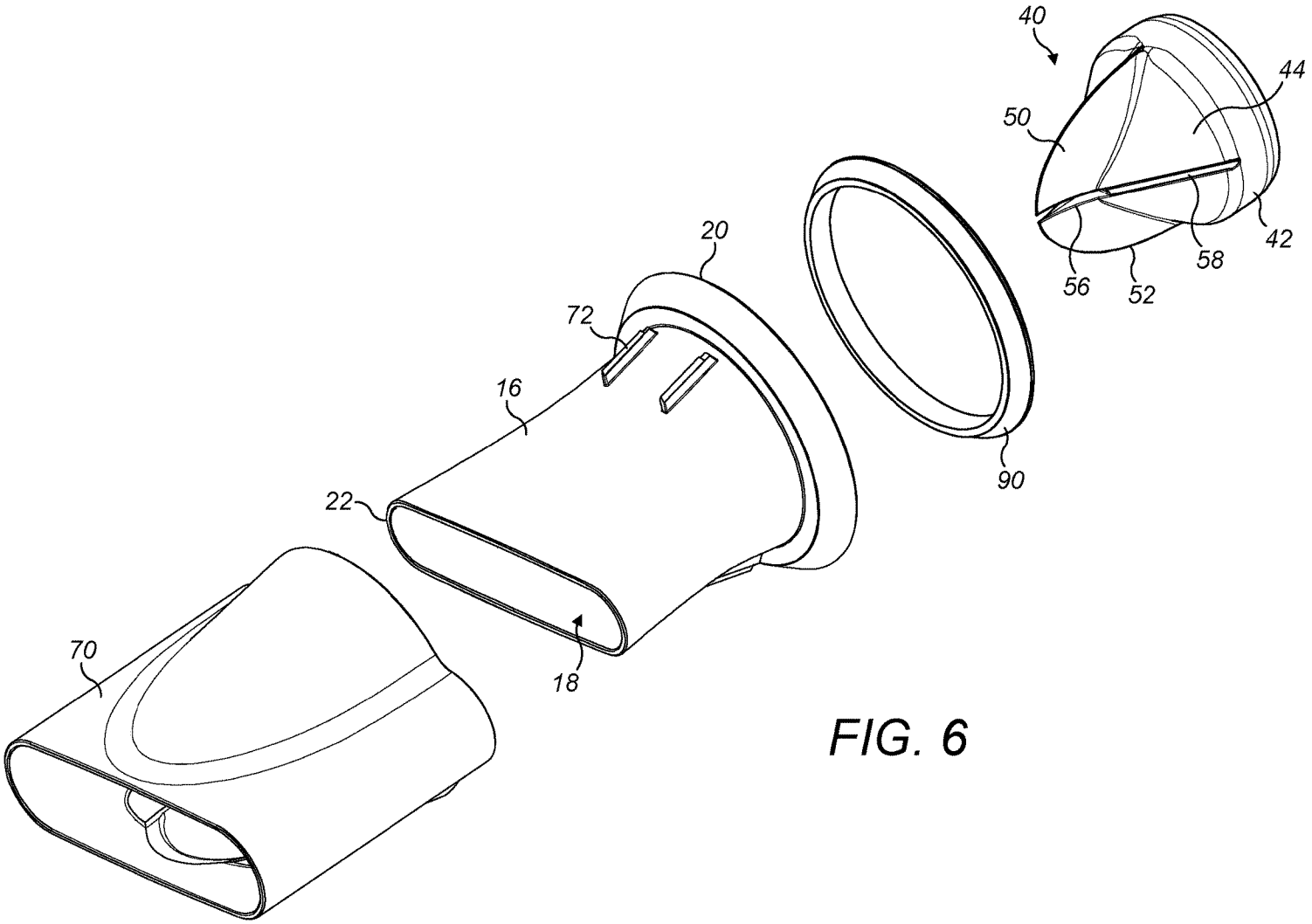
FIG. 6 is an exploded view of the nozzle.
Figure 7A:
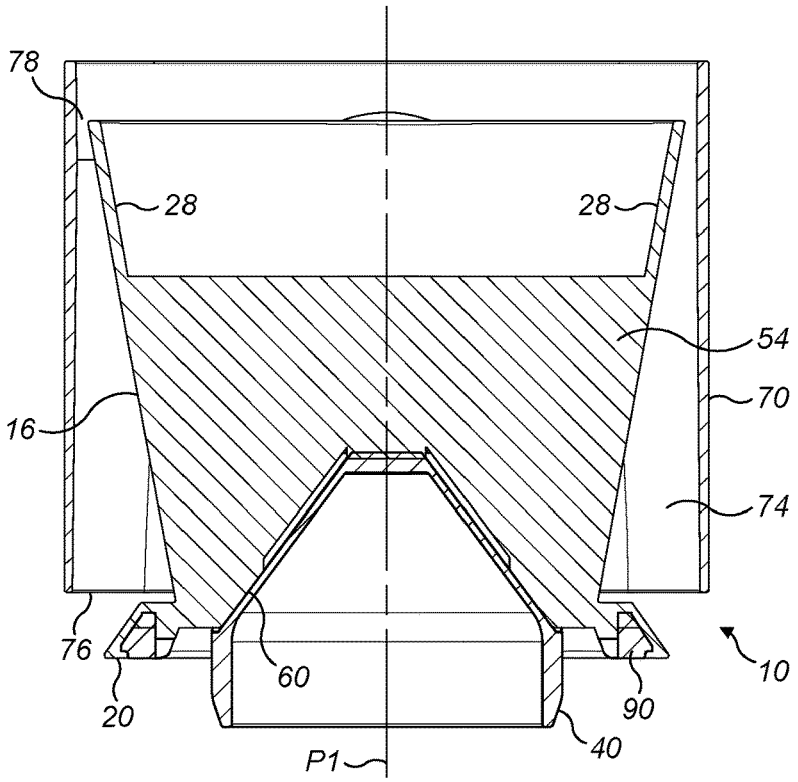
FIG. 7(*a*) is a sectional view taken along line A-A in FIG. 5, FIG. 7(*b*) is a sectional view taken along line B-B in FIG. 6, and FIG. 7(*c*) is a sectional view taken along line C-C in FIG. 6, and FIG. 7(*d*) is a sectional view taken along line D-D in FIG. 6.
Figure 7B:
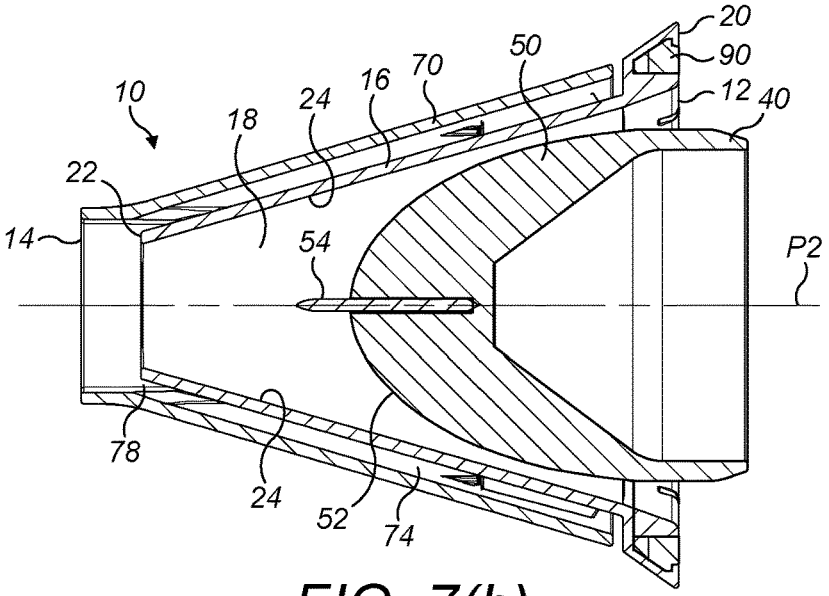
Figure 7C:
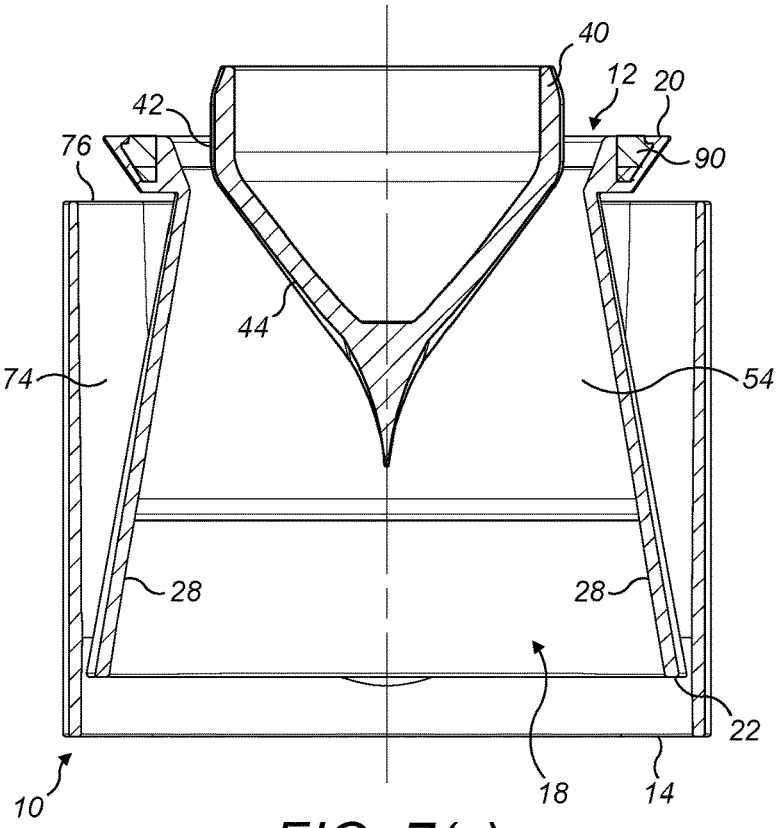
Figure 7D:
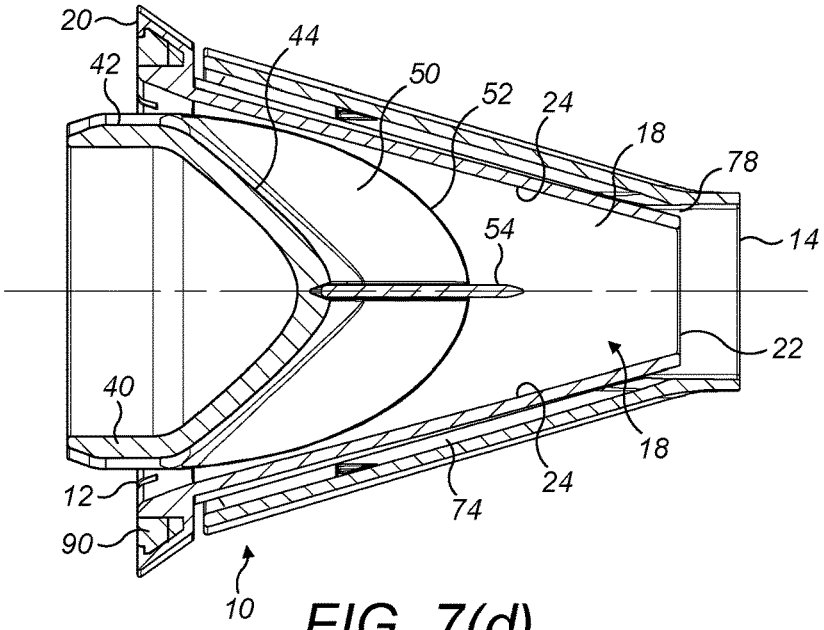

With reference also to FIG. 6, the air inlet 12 of the nozzle 10 is partially defined by a body 16 of the nozzle 10. The body 16 comprises an internal surface which defines an airflow duct 18 of the nozzle 10. The airflow duct 18 extends from an air inlet end 20 of the body 16 to an air outlet end 22 of the body 16. The air inlet end 20 of the body 16 is generally circular in shape, whereas the air outlet end 22 of the body 16 is slot-shaped, and in this embodiment in the form of an elongate slot having a width which is greater than its height. The air outlet end 22 of the body 16 has a similar shape to the air outlet 14 of the nozzle 10, the air outlet 14 of the nozzle 10 protruding forwardly (in the direction of air emission from the nozzle 10) of the air outlet end 22 of the body 16.

The internal surface of the body 16 comprises a plurality of surface sections. With reference to FIGS. 7(*a*) to 7(*d*), the internal surface comprises a pair of opposing first surface sections 24 which taper inwardly towards the air outlet end 22 of the body 16. At the air outlet end 22, the first surface sections 24 are generally parallel, and define parallel, elongate portions 26 of the periphery of the air outlet end 22 of the body 16. FIG. 7(*b*) is a cross-section of the nozzle 10, taken along a first plane P1 which, at the air outlet end 22, intersects orthogonally the mid-points of the elongate portions 26 of the periphery of the air outlet end 22. In that cross-section, each of the first surface sections 24 is inclined relative to a second plane P2, orthogonal to the first plane P1 and midway between the elongate potions 26, by an angle between 0 and 20°, and in this embodiment by an angle of 15°.

The internal surface of the body 16 further comprises a pair of opposing second surface sections 28 located between the first surface sections 24, and which taper outwardly towards the air outlet end 22 of the body 16. At the air outlet end 22, the second surface sections 28 define semi-circular end portions 30 of the air outlet end 22 of the body 16. FIG. 7(*a*) is a cross-section of the nozzle 10, taken along the second plane P2. In that cross-section, each of the second surface sections 28 is inclined relative to the first plane P1 by an angle in the range from 5 to 15°, and in this embodiment by an angle of 10°.

An airflow guiding member 40 is located at least partially within the airflow duct 18. In this embodiment, the airflow guiding member 40 protrudes rearwardly from the air inlet end 20 of the body 16. The air inlet 12 is located between the body 16 and the airflow guiding member 40; the body 16 defines an outer circular periphery of the air inlet 12 of the nozzle 10, whereas the airflow guiding member 40 defines the inner circular periphery of the air inlet 12.

The airflow guiding member 40 has an outer surface which faces the internal surface of the body 16. The outer surface has rear section 42 which is cylindrical in shape and a front section which has the general shape of a duck's bill. The front section has a conical outer surface 44 and a first airflow guiding vane 50 protruding forwardly from the front, or distal, end of the conical outer surface 44. The first airflow guiding vane 50 is planar in shape, and has a curved front edge 52. The first airflow guiding vane 50 is located in the first plane P1, and so is located midway between the second surface sections 28 of the internal surface of the body 16.

The airflow guiding member 40 is connected to a second airflow guiding vane 54 located within the airflow duct 18. The second airflow guiding vane 54 is connected to the internal surface of the body 16, and is shaped so as to extend across the airflow duct 18. The second airflow guiding vane 54 is planar in shape. The second airflow guiding vane 54 is located in the second plane P2, and so is located midway between the first surface sections 24 of the internal surface of the body 16. The tip of the first airflow guiding vane 50 comprises a slot 56 for receiving a central portion of the second airflow guiding vane 54, and a groove 58 for receiving at least part of the rear edge 60 of the second airflow guiding vane 54. During assembly, to connect the airflow guiding member 40 to the body 16 the airflow guiding member 40 is inserted into the airflow duct 18 through the air inlet end 20 so that the central portion of the second airflow guiding vane 54 enters the slot 56 and until the rear edge 60 of the second airflow guiding vane 54 engages the groove 58. This can ensure that the first airflow guiding vane 50 is orthogonal to the second airflow guiding vane 54 in the assembled nozzle 10. The airflow guiding member 40 is immovably connected to the body 16, for example, using an adhesive, or using ultrasonic welding.

As a hot airflow passes through the nozzle 10, the temperature of the external surface of the body 16 will rise. To shield the user from the body 16 during handling of the nozzle 10, the nozzle 10 further comprises a sleeve 70 which surrounds the body 16. One end of the sleeve 70 defines the air outlet 14 of the nozzle 10. The sleeve 70 is connected to fins 72 located on the outer surface of the body 16. To prevent the temperature of the external surface of the sleeve 70 from approaching that of the body 16 during use, the sleeve 70 defines with the outer surface of the body 16 an airflow channel 74 through which ambient air is drawn by the emission of air from the air outlet end of the body 16. This allows heat to be transferred to the ambient airflow passing over the outer surface of the body 16. The airflow channel 74 comprises air inlets 76 located adjacent the air inlet end 20 of the body 16, and an air outlet 78 surrounding the air outlet end 22 of the body 16 so that the ambient airflow merges with the airflow emitted from the body 16 upstream from the air outlet 14 of the nozzle 10.

Figure 8:
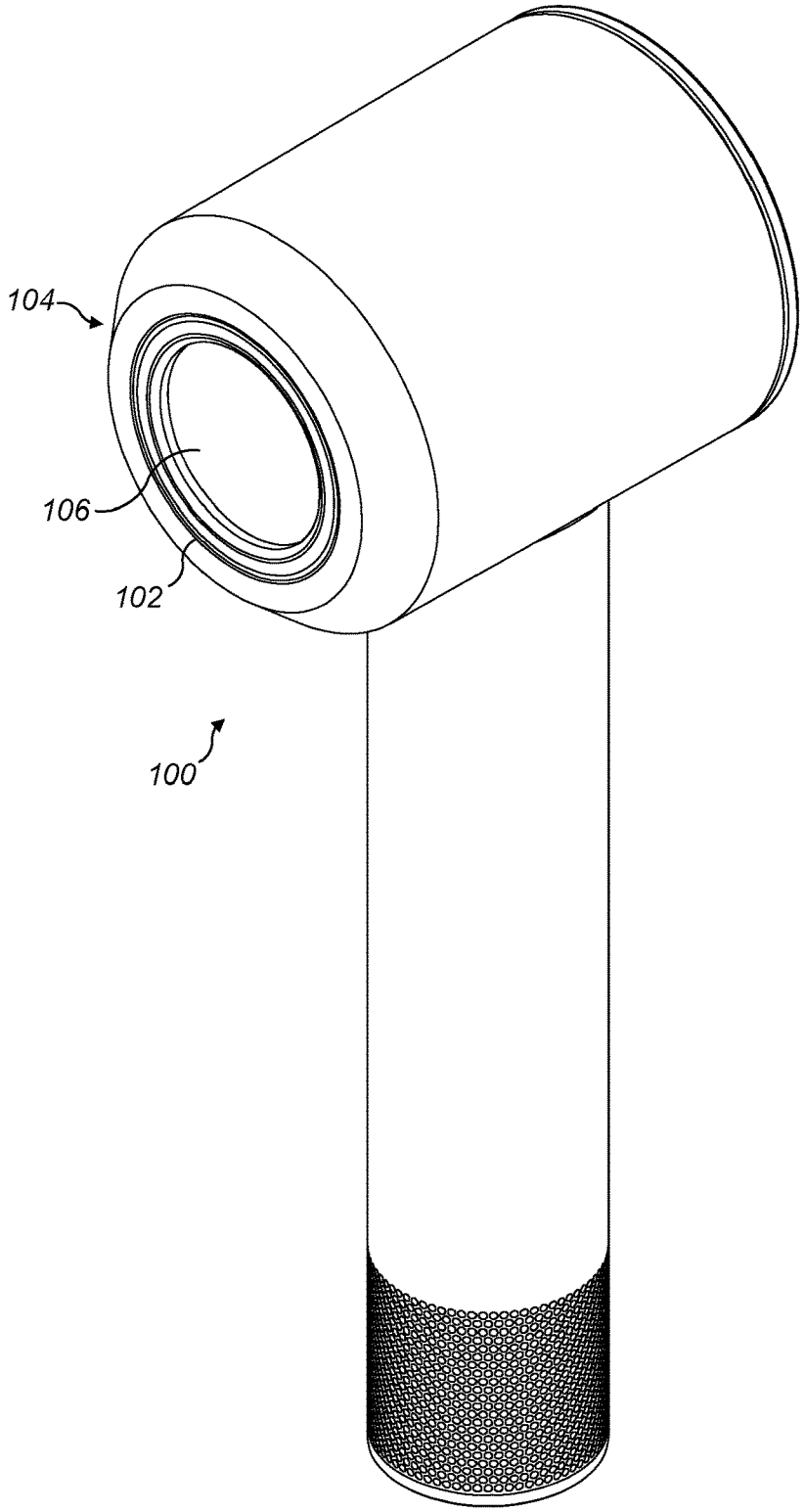
FIG. 8 is a left side, front perspective view, from above, of an example of a hair dryer to which the nozzle may be connected.

In use, the nozzle 10 is attached to the airflow outlet end of a hair dryer. For example, the nozzle 10 may be attached to the hair dryer by a magnet 90 located at the air inlet end 20 of the body 16. An example of a hair dryer 100 to which the nozzle 10 may be attached is illustrated in FIG. 8. Such a hair dryer 100 is described in WO2015/001306, the contents of which are incorporated herein by reference, in which a hot airflow is emitted from an annular slot 102 located at the air outlet end 104 of the hair dryer 100. The slot 102 extends around a bore 106 of the hair dryer 100. The airflow passes through the air inlet 12 of the nozzle 10 to enter the airflow duct 18. Within the airflow duct 18, the air guiding member 40 serves to guide a first portion of the airflow towards a first one of the second surface sections 28, and to guide a second portion of the airflow towards a second one of the second surface sections 28. At least some of each portion of the airflow can become attached to its respective second surface section 28, which can allow the second surface sections 28 to guide the airflow towards the semi-circular end portions 30 of the air outlet end 22 of the body 16. This can enables the nozzle 10 to emit an airflow with an outwardly flared profile. The second airflow guiding vane 54 encourages the emission of a relatively narrow laminar airflow from the nozzle 10.

The invention claimed is:

1. A nozzle for attachment to an airflow outlet end of a hair dryer, the nozzle comprising:

a body comprising an internal surface which defines an airflow duct which extends from an air inlet end to a slot-shaped air outlet end, the internal surface comprising a pair of opposing first surface sections which taper inwardly towards the air outlet end, and a pair of opposing second surface sections which taper outwardly towards the air outlet end; and an airflow guiding member, located at least partially within the airflow duct, for guiding a first portion of a received airflow towards one of the second surface sections, and a second portion of the received airflow towards the other of the second surface sections.

2. The nozzle of claim 1, wherein the air inlet end is generally circular in shape.

3. The nozzle of claim 1, wherein the airflow guiding member is located at least partially within the air inlet end of the airflow duct and defines with the body at least one air inlet of the nozzle.

4. The nozzle of claim 3, wherein the at least one air inlet comprises at least one slot.

5. The nozzle of claim 4, wherein the at least one air inlet comprises an annular slot.

6. The nozzle of claim 1, wherein at least part of the outer surface of the airflow guiding member tapers inwardly towards the air outlet end.

7. The nozzle of claim 1, wherein at least part of the outer surface of the airflow guiding member has the general shape of a duck's bill.

8. The nozzle of claim 1, wherein the airflow guiding member comprises an airflow guiding vane.

9. The nozzle of claim 8, wherein the airflow guiding vane is located within a first plane, and wherein, in a cross-section taken along a second plane orthogonal to the first plane, each of the second surface sections is inclined relative to the first plane by an angle in the range from 5 to 15°.

10. The nozzle of claim 9, wherein, in a cross-section taken along the first plane, each of the first surface sections is inclined relative to the second plane by an angle between 0 and 20°.

11. The nozzle of claim 8, wherein the body comprises a second airflow guiding vane which extends across the airflow duct.

12. The nozzle of claim 11, wherein the second airflow guiding vane is substantially orthogonal to the airflow guiding vane of the airflow guiding member.

13. The nozzle of claim 11, wherein the airflow guiding vane of the airflow guiding member comprises a slot for receiving part of the second airflow guiding vane.

14. The nozzle of claim 1, comprising a sleeve which extends about the body, and which defines an airflow channel through which ambient air is drawn by the emission of air from the air outlet end of the body.

* * * * *